US005807001A

United States Patent [19]

Hammill et al.

[11] Patent Number: 5,807,001

[45] Date of Patent: Sep. 15, 1998

[54] END OF RIBBON INDICATOR FOR A CASSETTE

[75] Inventors: Susan M. Hammill; Mark J. Poydock, both of Buffalo, N.Y.

[73] Assignee: IIMAK, Amherst, N.Y.

[21] Appl. No.: 843,230

[22] Filed: Apr. 14, 1997

[51] Int. Cl.[6] ..... B41J 33/32

[52] U.S. Cl. ..... 400/249; 400/703; 242/344; 116/284

[58] Field of Search ..... 400/249, 703, 400/247, 244, 243, 242, 219, 219.2; 242/563.2, 563.1, 563, 344; 116/284, 298, 318

[56] References Cited

U.S. PATENT DOCUMENTS

| | | | |
|---|---|---|---|
| 879,159 | 2/1908 | Fox | 400/242 |
| 2,937,818 | 5/1960 | Zorn | 242/344 |
| 3,718,290 | 2/1973 | Wright | 242/344 |
| 3,894,507 | 7/1975 | Joechlin | 242/344 |
| 3,913,200 | 10/1975 | Kossor | 242/344 |
| 4,479,730 | 10/1984 | Yoshioka et al. | 400/208 |
| 5,370,332 | 12/1994 | Goff et al. | 242/344 |
| 5,492,422 | 2/1996 | Kondo | 400/208 |

FOREIGN PATENT DOCUMENTS

| | | | |
|---|---|---|---|
| 0054969 | 3/1986 | Japan | 400/242 |
| 406234252 | 8/1994 | Japan | 400/242 |
| 2266272 | 10/1993 | United Kingdom | 400/242 |

*Primary Examiner*—Edgar S. Burr
*Assistant Examiner*—Anthony H. Nguyen
*Attorney, Agent, or Firm*—Nixon, Hargrave, Devans & Doyle LLP

[57] ABSTRACT

A cassette with an end of ribbon indicator or mark in accordance with the present invention includes a spool for storing the useable ribbon, a pair of end hubs, and at least one end of ribbon mark. One of the end hubs is connected to each end of the spool. Each of the end hubs has an inner surface facing the spool which includes the end of ribbon mark. The mark indicates how much usable ribbon is left on the spool. Preferably, the marks comprise a plurality of concentric rings centered around an axis extending along the length of the center of the spool.

16 Claims, 4 Drawing Sheets

END OF RIBBON INDICATOR FOR A CASSETTE

FIELD OF THE INVENTION

This invention relates generally to a cassette for a printer and, more particularly, to an end of ribbon indicator for a cassette in a thermal transfer printer.

BACKGROUND OF THE INVENTION

Typically, a printer, such as thermal transfer printer, includes a removable cassette which contains a ribbon coated with ink. During printing operations, the ribbon in the cassette is advanced as it is being used until the end of the ribbon is reached.

One problem which occurs during these printing operations is that the operator has no idea how much useable ribbon is left in the cassette before starting each job. As a result, during some printing operations the cassette runs out of useable ribbon before the printing job is completed, rendering the entire job useless. This is a tremendous loss of time and money, especially on large jobs.

SUMMARY OF THE INVENTION

A cassette or cartridge with an end of ribbon indicator or mark in accordance with the present invention includes a supply spool for storing the useable ribbon, a pair of end hubs, and at least one end of ribbon mark. One of the end hubs is connected to each end of the supply spool. Each of the end hubs has an inner surface facing the supply spool which includes the end of ribbon indicator or mark. The mark indicates how much usable ribbon is left on the supply spool. Preferably, the marks comprise a plurality of concentric rings centered around an axis extending along the length of the center of the supply spool.

A cassette with an end of ribbon indicator in accordance with the present invention provides a number of advantages. For example, the end of ribbon mark indicates how much useable ribbon is left on the cassette. Additionally, the end of ribbon mark indicates when the supply of useable ribbon is low and about to run out. Further, the addition of the end of ribbon indicator mark in the cassette is relatively inexpensive when compared to the overall cost of the cassette and also to the cost of materials and time which would be lost if the printer ran out of usable ribbon before the printing job was completed.

DETAILED DESCRIPTION

Figure 1:
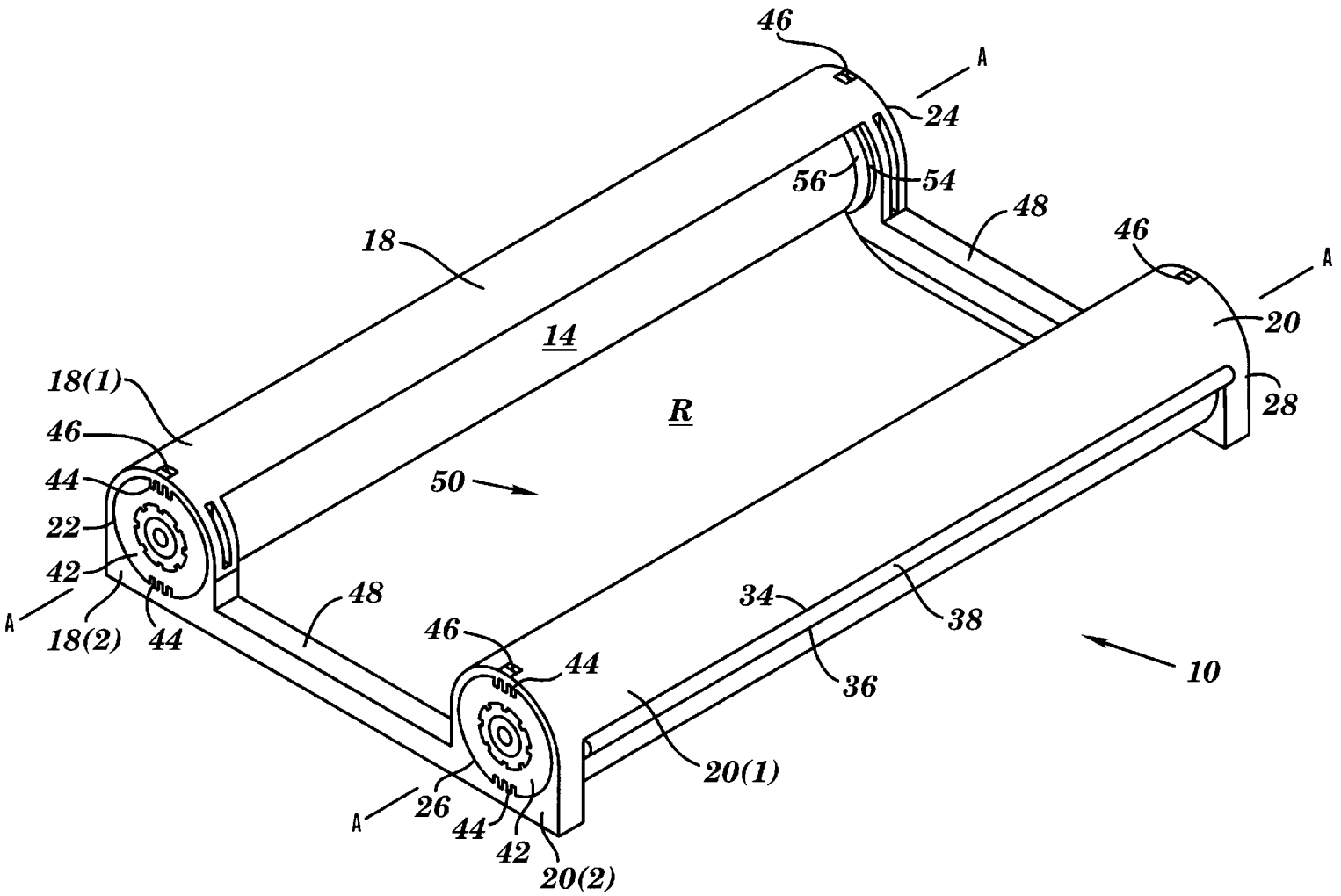
FIG. 1 is a perspective view of a thermal transfer ribbon cassette with an end of ribbon indicator or mark in accordance with the present invention.

A cassette or cartridge 10 with an end of ribbon indicator or mark 12 in accordance with the present invention is illustrated in FIG. 1. The cassette 10 includes a supply spool 14 for storing the useable ribbon R, end hubs 16, and at least one end of ribbon mark 12. The cassette 10 with the end of ribbon mark 12 provides a number of advantages, such as indicating of how much useable ribbon R is left and indicating when the useable ribbon R is about to run out.

Figure 3:
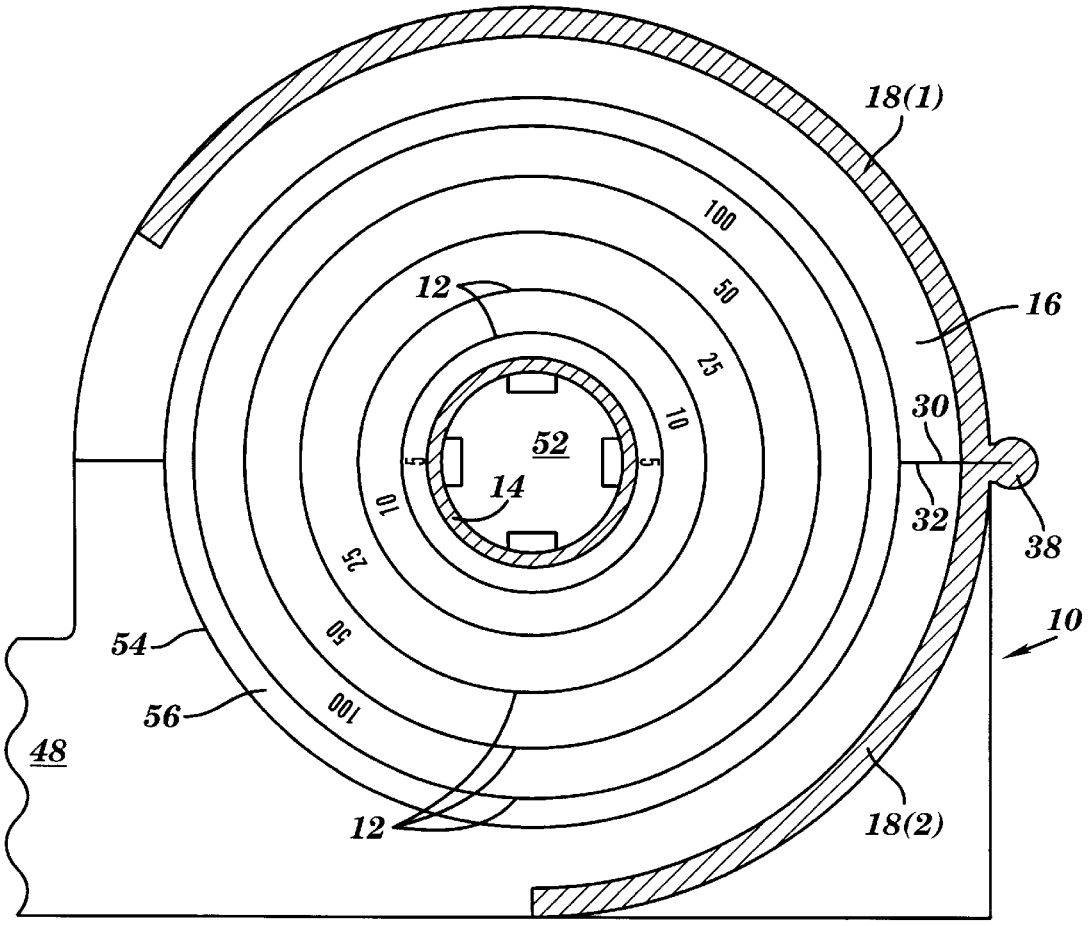
FIG. 3 is a cross-sectional view of the cassette with the end of ribbon indicator taken along lines 3—3 in FIG. 2.
Figure 4:
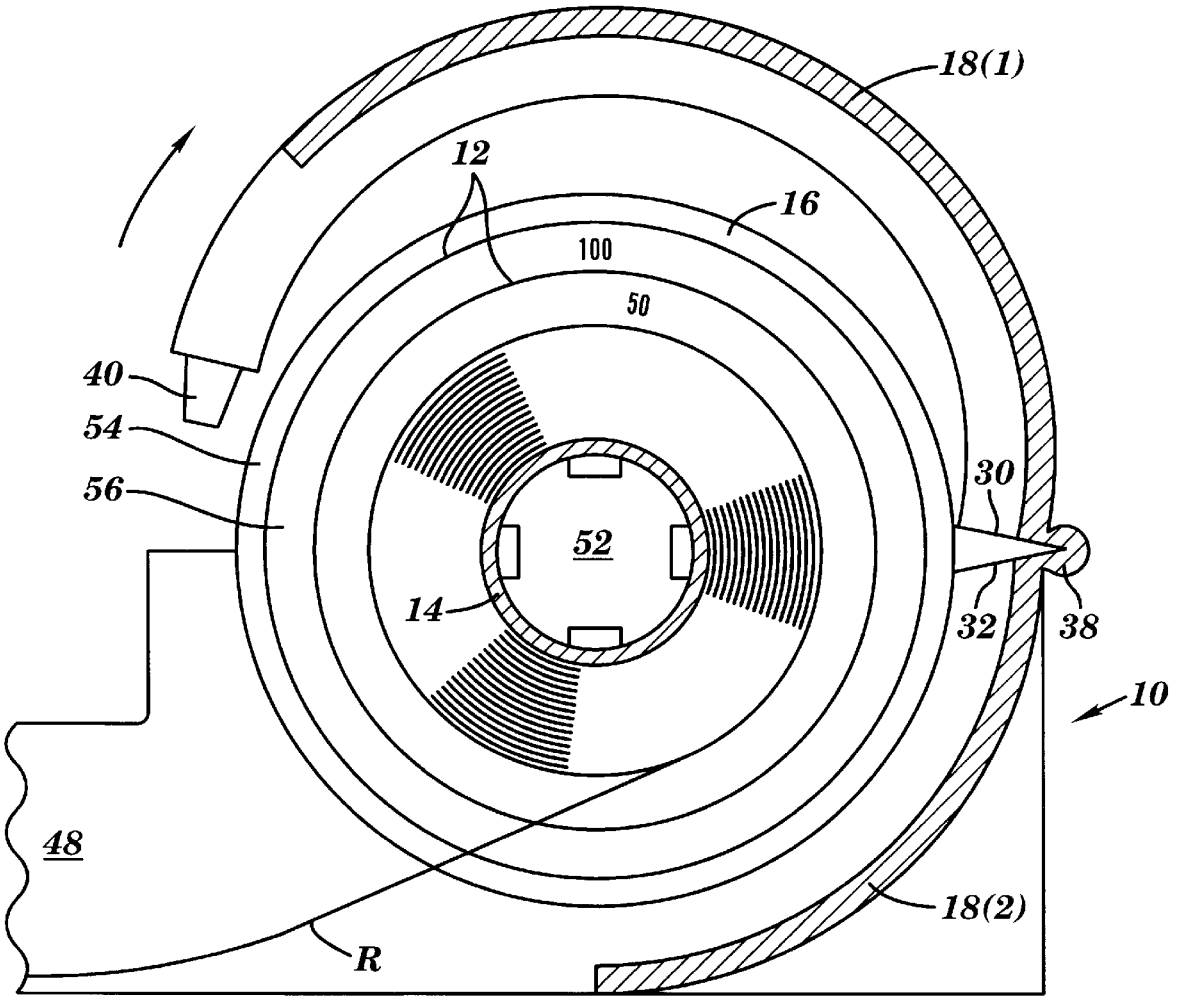
FIG. 4 is a cross-sectional view of the cassette with the end of ribbon indicator with ribbon on the spool.

Referring to FIGS. 1, 3, and 4, the cassette or cartridge 10 includes a pair of spool housings 18 and 20 which house the supply spool 14 and a take-up spool (not shown). In this particular embodiment, each spool housing 18 and 20 includes a pair of substantially semi-cylindrical, spool closures 18(1), 18(2), 20(1), and 20(2) are open at opposing ends 22, 24, 26, and 28. Each semi-cylindrical, spool closure 18(1), 18(2), 20(1), and 20(2) has an elongated edge 30, 32, 34, and 36 which extends along the length of the closure 18(1), 18(2), 20(1), and 20(2). A living hinge 38 pivotally connects elongated edges 30 and 32 and elongated edges 34 and 36 together to form two clam shell-like structures. A locking pin 40 extending away from the other side of spool closure 18(1) and 20(1) from elongated edges 30 and 34 mates with an opening (not shown) on the other side of spool closure 18(2) and 20(2) from elongated edges 32 and 36 to align the semi-cylindrical, spool closures 18(1) and 18(2) together and to align spool closures 20(1) and 20(2) together when closed.

Figure 2:
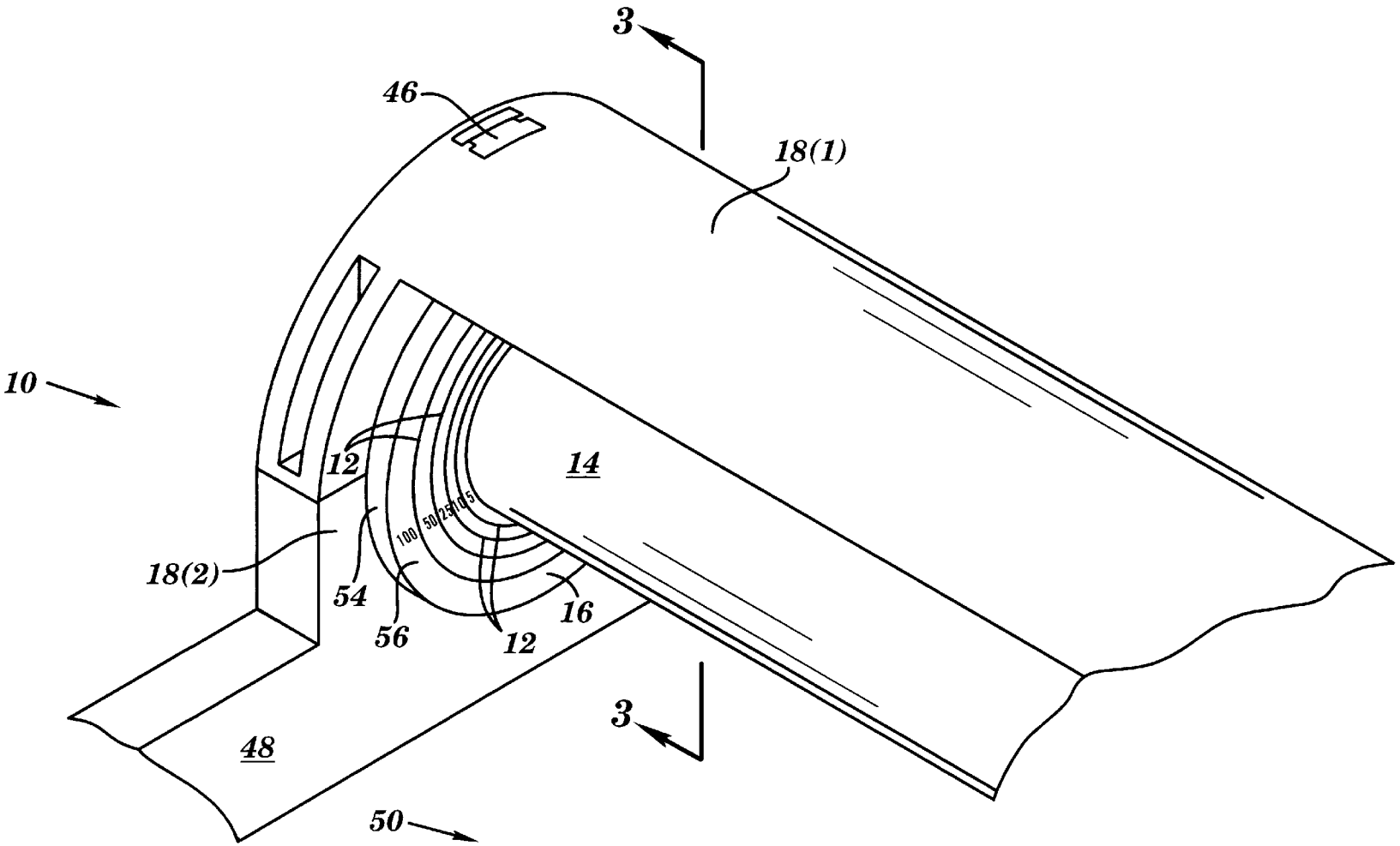
FIG. 2 is a perspective view of a portion of the cassette with an end of ribbon indicator shown in FIG. 1.

Referring to FIGS. 1 and 2, an end cap 42 is mounted in the opening at each end 22, 24, 26, and 28 of each spool housing 18 and 20. The end caps 42 hold the semi-cylindrical, spool closures 18(1) and 18(2) as well as spool closures 20(1) and 20(2) together in a closed position. In this particular embodiment, each end cap 42 has a pair of locking tabs 44 which snap into openings 46 in the spool housings 18 and 20.

Referring to FIG. 1, the cassette 10 also includes a pair of side rails 48. Each end of each side rail 48 is integrally formed with one end 22, 24, 26, and 28 of the spool housings 18 and 20 to create a substantially rectangularly-shaped cassette 10. An opening or imaging window 50 is defined between the side rails 48 and the spool housings 18 and 20. The imaging window 50 provides an opening for a thermal print head (not shown) from a printer (not shown) to contact the ribbon R and generate an image on a web or feeder sheet (not shown).

Referring to FIGS. 1, 2 and 4, the cassette 10 also includes the supply spool 14 for storing useable ribbon and a take-up spool (not shown) for storing used ribbon. In this particular embodiment, the supply and take-up spool 18 and 20 have a hollow core 52 which extends along the length of the supply and take-up spools. The supply spool 14 is mounted in the supply spool housing 18 and the take-up spool is mounted in the take-up spool housings 20. Ribbon R stored on the supply spool 14 extends across the imaging area 50 to the take-up spool. As the ribbon R is used by the printer, the ribbon R is advanced and stored on the take-up reel.

Referring to FIGS. 2–4, an end hub 54 is either integrally formed with or is mounted or secured into the hollow core 52 at each end of the supply spool 14 and at each end of the take-up spool. Each end hub 54 has an inner surface 56 which faces the supply or take-up spool. In this particular embodiment, each end hub 54 has an substantially circular shape and is centered on an axis A—A which extends along the length and through the center of supply spool 14 and also the take-up spool.

A plurality of concentric marks 12 are located on the inner surface 56 of at least one of the end hubs 54 for the supply spool 14. Alternatively, the marks or indicators 12 could be located on the take-up spool and would indicate how much ribbon R has been used, rather than how much is left. A variety of different types of marks 12 may be used, such as raised ridges on the inner surface 56 or grooves on the inner surface 56. In this particular embodiment, a plurality of concentric marks 12 centered around an axis A-A which extends through the center of the length of the supply spool 14 are used. Additionally in this particular embodiment, each of the marks 12 includes a designation, such as 100, 50, 25, 10, or 5, which indicates how many meters or yards of useable ribbon R remain on the supply spool 14. The shape of the marks 12, the particular number of marks 12, and the particular designations on the marks 12 can vary as needed or desired. The marks 12 may also be located on a label which is secured or mounted on to the inner surface 56 of the end hub 54 by means, such as an adhesive or a printed ring with no adhesive. When the label or printed ring is mounted on the inner surface 56, it is important that it is centered properly to assure accuracy. Further, in this particular embodiment, the portion of the inner surface 56 inside the innermost mark 12 is shaded a different color than the remainder of the inner surface 56, such as red.

The operation of the cassette 10 with the end of ribbon indicators or marks 12 will be discussed with reference to FIGS. 1–4. When a printing job is begun, the useable ribbon on the supply spool 14 is fed across the imaging area 50 and is rolled up on the take-up reel. As the ribbon R is advanced, the outside diameter of useable ribbon R on the supply spool 14 is reduced which exposes more indicators or marks 12 on the inner surface 56 of the end hub 54. The indicator or mark 12 closest to the outer diameter of the remaining ribbon R on the supply spool 14 indicates to the operator of the printer how many meters or yards of useable ribbon R are left (depending upon the particular designation selected for measurement of the ribbon). Accordingly, to avoid running out of useable ribbon R during a printing job, the operator will first look at the end of ribbon indicators or marks 12 on the inner surface 56 of one of the end hubs 54 of the supply spool 14. If there is enough ribbon left for the printing job, the operator will continue with that cassette 10. Otherwise, the operator will replace the cassette 10 with one that has enough useable ribbon R left for the job. Thus, with the present invention, the operator is able to save time and money that would otherwise be lost if the cassette 10 ran out of useable ribbon R before the job was completed.

When the outside diameter of the ribbon R is reduced below the innermost indicator or mark 12 on the inner surface 56 of the end hub 54, in this particular embodiment the color of the inner surface 56 changes to red or some other color to signal to the operator that the useable ribbon R on the supply spool 14 is about to run out.

By way of example, in FIG. 4 the operator would look and see that the outside diameter of the useable ribbon R is below the one-hundred and the fifty indicators or marks 12, but is above the twenty-five indicator or mark 12. Accordingly, the operator would know that there is between twenty-five to fifty yards or meters of ribbon R left (depending upon the particular designation selected for measurement of the ribbon). If the operator knew that the printing job required more than twenty-five yards or meters of ribbon R, then the operator would need to replace the cassette 10 with a cassette 10 with an appropriate amount of ribbon R left. If the printing job required less than twenty-five yards or meters of ribbon R, then the operator would not need to replace the cassette 10.

Having thus described the basic concept of the invention, it will be rather apparent to those skilled in the art that the foregoing detailed disclosure is intended to be presented by way of example only, and is not limiting. Various alternations, improvements, and modifications will occur and are intended to those skilled in the art, though not expressly stated herein. These alterations, improvements, and modifications are intended to be suggested hereby, and are within the spirit and scope of the invention. Accordingly, the invention is limited only by the following claims and equivalents thereto.

What is claimed is:

1. A cassette comprising:

a spool for storing an ink ribbon;

a pair of end hubs connected to opposing ends of the spool, the end hubs having an inner surface facing the spool;

at least one mark on the inner surface of one of the end hubs for the spool which provides an indication of how much of the ink ribbon is stored on the spool; and a spool housing, the spool mounted in the spool housing which has an opening which extends substantially along the length of the supply spool and provides visual access to the mark on the inner surface of one of the end hubs.

2. The cassette as set forth in claim 1 wherein the mark is circular.

3. The cassette as set forth in claim 1 wherein the mark comprises a raised ridge on the inner surface.

4. The cassette as set forth in claim 1 wherein the mark comprises a groove on the inner surface.

5. The cassette as set forth in claim 1 wherein the portion of the inner surface inside the innermost mark is shaded a different color than the remainder of the inner surface.

6. The cassette as set forth in claim 5 wherein the color is red.

7. The cassette as set forth in claim 1 further comprising at least one mark on the inner surface of the other one of the end hubs for the spool, which provides an indication of how much of the ink ribbon is stored on the spool.

8. A thermal transfer ribbon cassette with a ribbon, the cassette comprising:

a supply spool for storing the ribbon;

a take-up spool for receiving the ribbon;

an end hub secured to each end of the supply spool, each of the end hubs having an inner surface facing the supply spool;

a plurality of concentric marks on the inner surface of one of the end hubs for the supply spool, which provides an indication of how much of the ink ribbon is stored on the supply spool;

a supply spool housing, the supply spool mounted in the supply spool housing which has an opening which extends substantially along the length of the supply spool and provides visual access to the plurality of concentric marks on the inner surface of one of the end hubs for the supply spool; and a take-up spool housing, the take-up spool mounted in the take-up spool housing.

9. The cassette as set forth in claim 8 wherein the marks comprise grooves on the inner surface.

10. The cassette as set forth in claim 8 wherein the portion of the inner surface inside the innermost mark is shaded a different color than the remainder of the inner surface.

11. The cassette as set forth in claim 10 wherein the color is red.

12. The cassette as set forth in claim 8 further comprising a plurality of concentric marks on the inner surface of the other one of the end hubs for the supply spool which provide an indication of how much of the ink ribbon is stored on the supply spool.

13. The cassette as set forth in claim 8 further comprising a plurality of concentric marks on the inner surface of one of the end hubs for the take-up spool and which provides an indication of how much of the ink ribbon is stored on the take-up spool and wherein the the take-up spool housing has an opening which extends substantially along the length of the take-up spool and provides visual access to the plurality of concentric marks on the inner surface of one of the end hubs for the take-up spool.

14. The cassette as set forth in claim 8 wherein the marks comprise raised ridges on the inner surface.

15. The cassette as set forth in claim 8 further comprising:

a plurality of concentric marks on the inner surface of the other one of the end hubs for the supply spool which provides an indication of how much of the ink ribbon is stored on the supply spool; and a plurality of concentric marks on inner surfaces of both end hubs for the take-up spool which provide an indication of how much of the ink ribbon is stored on the take-up spool.

16. The cassette as set forth in claim 15 wherein the take-up spool housing has an opening which extends substantially along the length of the take-up spool and provides visual access to the plurality of concentric marks on the inner surface of one of the end hubs for the take-up spool.

* * * * *